United States Patent [19]

Ranzi

[11] 4,078,363

[45] Mar. 14, 1978

[54] MACHINE FOR WRAPPING ARTICLES IN STRETCHABLE FILM

[75] Inventor: Marilena Ranzi, Viganello, Switzerland

[73] Assignee: Pittacus S. A., Eschen, Liechtenstein

[21] Appl. No.: 766,459

[22] Filed: Feb. 7, 1977

[30] Foreign Application Priority Data

Feb. 11, 1976 Italy ..... 12466/76

[51] Int. Cl.[2] ..... B65B 11/20

[52] U.S. Cl. ..... 53/228

[58] Field of Search ..... 53/228, 220, 232

[56] References Cited

U.S. PATENT DOCUMENTS

| | | | |
|---|---|---|---|
| 3,267,642 | 8/1966 | Broadbent | 53/228 |
| 3,683,586 | 8/1972 | Duckhinsky et al. | 53/228 |

*Primary Examiner*—Travis S. McGehee

*Attorney, Agent, or Firm*—Pollock, Vande Sande & Priddy

[57] ABSTRACT

The machine for the wrapping of articles in stretchable film of soft plastic material comprises a platform presenting a horizontal flat surface, onto which the article to be wrapped is positioned. The said platform is moved along a quadrangular path, effecting sequentially a lower horizontal run, during which it becomes loaded with the article, a upwardly directed vertical run, which brings the article in contact with the wrapping film and during which the proper wrapping cycle is started, a horizontal upper run, during which the wrapping operation is completed and the article is transferred away from the platform, and a downwardly directed vertical run, which brings again the platform to its loading position.

5 Claims, 12 Drawing Figures

F
28
26
27
24
21
22
C
Z
25
125
D
B
A
12
1
33
31
32
121
P
19
17
34
30
20
16

F
28
26
24
27
25
125
121
12
33
P
1
32
31
34
30

Fig.11
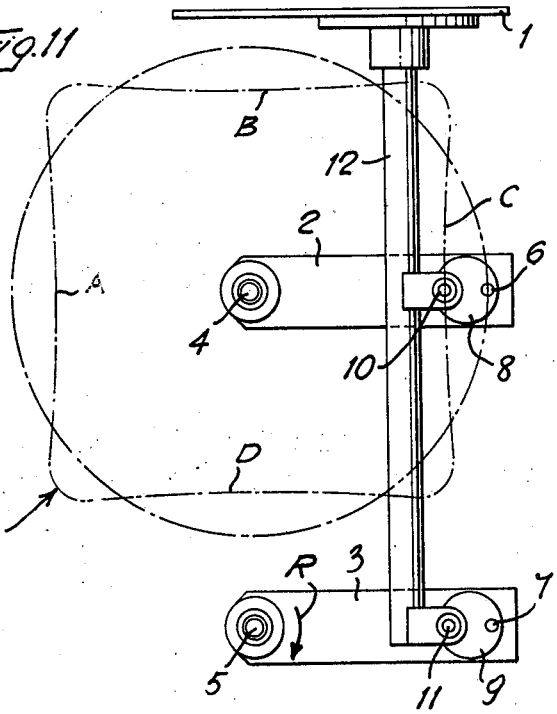
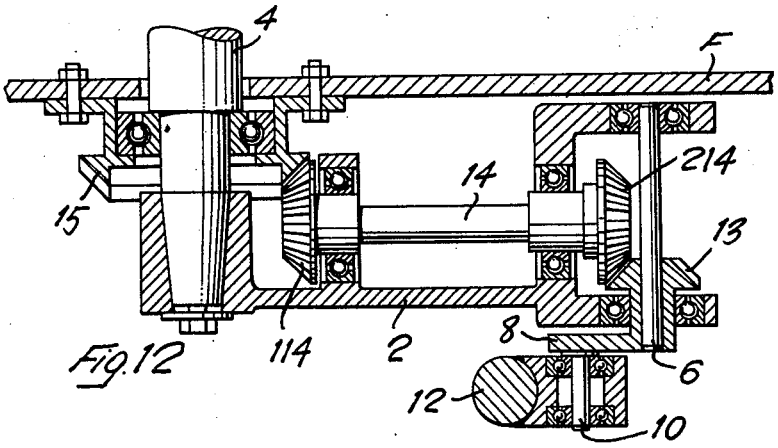
Fig.12

MACHINE FOR WRAPPING ARTICLES IN STRETCHABLE FILM

BACKGROUND AND SUMMARY OF THE INVENTION

The present invention relates to a machine for the wrapping of articles in stretchable film of soft plastic material.

There are known, for example from U.S. Pat. No. 3,662,513 (FABBRI) and from U.S. Pat. No. 3,967,433 (BONFIGLIOLI), machines which carry out the wrapping of articles in stretchable foils of soft plastic material. Such machines of the prior art present however the inconvenience, whenever it is desired to wrap in a single package a plurality of loose articles, such as for example bottles or cans, that the said articles must be placed in suitable tray-like receptacles, since, during the wrapping operation, the whole item to be packaged is deposited on a vertically reciprocating lifting table the supporting surface of which is equipped with upwardly projecting supporting fingers or webs which are intended to be resiliently tipped over under the action of the folders which fold the edges of the film under the item. Obviously, the presence of the said upwardly directed resilient fingers or webs does not allow the stable positioning on the moving table of articles having a relatively small base such as bottles or cans. The problem of the stable positioning of this type of articles becomes precisely more evident in the case that it is desired to wrap in a single package a plurality of articles loosely arranged the one adjacent to the other.

It is the main object of the present invention to provide a machine for wrapping articles in stretchable film, which can wrap in a single package a plurality of articles such as bottles, cans, small boxes or the like, loosely arranged in groups of predetermined number.

It is a further object of the present invention to provide a machine for the wrapping of any articles in stretchable film, presenting remarkable operational speed characteristics, even higher than the operational speeds of the known machines.

In the machine according to the invention, the item to be packaged is supported by a platform which presents a horizontal flat surface onto which the item to be wrapped (consisting of one or more articles) can be steadily positioned without the need of a support container or tray, and onto which surface the item can be slidably moved, during the completion of the wrapping operation without prejudice for its stability.

The said platform is moved along a substantially quadrangular path, effecting sequentially a lower horizontal run, during which it is loaded with the article (or articles) to be wrapped, a upwardly directed vertical run, which brings the article in contact with the wrapping film and during which the proper wrapping cycle is started, a horizontal upper run, during which the wrapping operation is completed, and in the meantime the article being wrapped is gently transferred away from the platform, and a downwardly directed vertical run, which brings again the platform to its loading position.

The closed-circuit continuous translatory movement of the platform along the mentioned quadrangular path consents therefore high operational speeds, which cannot be attained by the known type machines which employ vertically reciprocating platforms.

The above and other objects and advantages of the wrapping machine according to the invention will appear evident from the following detailed description of a peferred embodiment of same, made, by way of non-limiting example, with reference to the attached drawings.

BRIEF DESCRIPTION OF THE DRAWINGS

FIG. 11 illustrates, in side view, the driving mechanism for imparting a quadrangular translatory motion to the lifting platform;

FIG. 12 is a section illustrating in detail the gear drive employed in the driving mechanism of FIG. 11.

DESCRIPTION OF THE PREFERRED EMBODIMENT

It is preliminarly to be noted that throughout the description and claims the term "article" or "articles" has been employed to designate the item to be wrapped. Particular attention (as already pointed out in the introductory part) is drawn to the fact that such "article" or "articles" may comprise a plurality of objects to be wrapped in a single package, such as may be bottles, cans, small boxes or the like, the said objects being loosely arranged the one next to the other in groups of a predetermined number. Of course the machine can handle as well single articles presenting a more regular shape, or loose articles arranged in tray-like containers, but it is pointed out that the representation in the attached drawings of a single article having substantially a parallelepipedal form, can by no means be considered as a limitation.

Figures 1, 2:
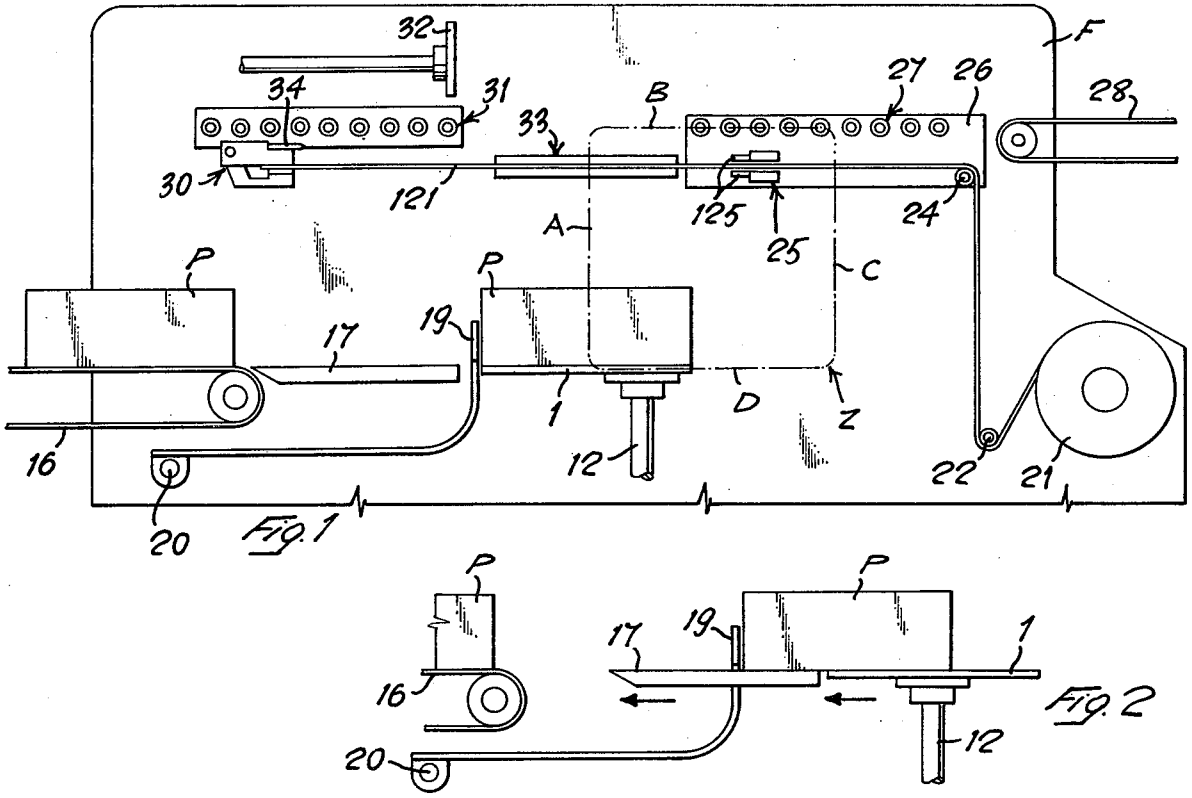
FIG. 1 is a diagrammatic side view of the wrapping machine according to the invention.
FIGS. 2 to 8 are diagrammatic side views illustrating details of as many steps of operation of the machine.

With particular reference to FIG. 1, the machine for wrapping articles in stretchable film comprises a stationary frame F which houses the mechanisms for the operation of the machine itself. The article or articles P to be wrapped are fed to the lifting platform 1 of the machine through the feeding conveyor 16 and the movable loading platform 17, in the manner which will be described later. The lifting platform 1, loaded with the article (or articles) P moves vertically upwardly (dash-and-dot line A) to a position where the wrapping of the article is initiated, said wrapping being completed during an horizontal upper run (dash-and-dot line B) at the end of which the wrapped article P is discharged through a delivery conveyor 28, while the platform 1 performs a downwardly directed vertical run (dash-and-dot line C) and then a horizontal lower run (dash-and-dot line D) during which it receives a new article (or articles) P to be wrapped, thus getting ready for the repetition of another wrapping cycle.

It can be therefore appreciated that, in order to preform a complete wrapping cycle, the platform 1, while maintaining a horizontal position of its supporting surface, is compelled to move along a quadrangular path Z, which is composed of the above mentioned substantially rectilinear runs A, B, C and D, which identify as many corresponding sides of an ideal square. Also, for the reasons which will appear more evident from the detailed description of the wrapping cycle which will be made after, and which can be briefly resumed in the requirement of avoiding brusque changes in the speed of the platform particularly in correspondence of the vertexes of the quadrangular path Z, which would cause an improper handling of the products carried by the platform or to be loaded on the platform itself, it is required that the platform 1 be moved along the quadrangular path at variable speeds, and more particularly that the speed of the platform progressively increase whenever same starts its movement from a vertex of a side of the square path Z towards the opposed side, reaching the maximum speed in correspondence of the middle of the side, and that the speed be progressively decreased as the platform gets near to the opposed vertex of the side.

Referring particularly to FIGS. 11 and 12, there is illustrated a preferred embodiment of a motion imparting device suitable for moving the lifting platform 1 along the mentioned quadrangular path at the desired speed characteristics. Said device comprises a pair of parallel levers of equal length 2, 3 driven in synchronous rotation (arrow R) by respective driving shafts 4, 5 which shafts are arranged vertically the one above the other. The levers 2, 3 rotatably support at their free ends, about pins 6, respectively 7, the crank discs 8 and 9 which, in correspondence of excentrically arranged pins 10, respectively 11, support the vertical rod 12 which carries at its upper end the lifting platform 1. The crank discs 8, 9 are positively driven by respective gear trains, one of which (the one which drives crank disc 8) is illustrated in FIG. 12. More particularly, crank disc 8 is driven by bevel gear 13, which meshes with bevel gear 214 keyed at one end of shaft 14, presenting keyed at its other end bevel gear 114 meshing with bevel gear 15 which is fixed to the machine frame F. The rotation of driving shaft 4 in the direction of arrow R will consequently cause the rotation of crank pin 8 in the contrary direction. The gear transmission is dimensioned in such a manner that at each complete rotation of shaft 4 (and 5) there will be effected four rotations of crank pin 8 (and 9). By positioning the gear train as illustrated in FIG. 11, that is with the axis of shaft 4 and pins 6 and 10 (and respectively the axis of shaft 5 and pins 7 and 11) in horizontal alignment, a complete rotation of associated shafts 4 and 5 will cause a translatory movement of platform 1 along the quadrangular path Z (composed of the four substantially rectilinear sides A, B, C and D) at the desired variable speeds.

With reference to FIG. 1, the machine further comprises a storage roll 21 from which a continuous web of stretchable film can be unrealed. The film web is guided over a first guide roller 22, and over a second guide roller 24 carried by a vertically movable structure 26, so as to reach with its leading end the distributing clamp 25, also carried by the said structure 26. On the vertically movable structure 26 there is also mounted a horizontal platform 27, consisting of a plurality of freely rotatable rollers. In the lower position of the vertically movable structure 26, the horizontal platform 27 is located at a level corresponding to the level of the upper horizontal run B of lifting platform 1. At this same level there is arranged the discharge conveyor 28.

On the machine there are further arranged: a horizontally movable unreeling clamp 30 provided on its upper side with a cutting blade 34; a horizontally movable folding and supporting platform 31 consisting of a plurality of freely rotatable rollers, said platform being located at a level corresponding to the level of the upper horizontal run B of the lifting platform 1; a pair of opposed movable side clamps 33, and finally an upper movable thrusting member 32.

OPERATION OF THE MACHINE

One or more articles P, coming from the feeding conveyor 16, are loaded on the intermediate loading platform 17, which is located at the same level of the lower horizontal run D of the lifting platform 1 (see FIG. 1) and is horizontally movable to and fro with respect to a barrier element 19, fulcrumed on axis 20. When the platform 17 has been loaded with the desired number of articles, the feeding from conveyor 16 is stopped (for example through photosensitive means, not shown), and the barrier element 19 is lowered so as to consent the horizontal displacement of the loaded platform 17 to a position beyond said barrier element 19 corresponding to the position of platform 1 whenever same reaches the vertex defined by sides D and A of the quadrangular path. At this moment, the barrier element 19 is again lifted, and the loading platform 17 is returned to its starting position, moving in synchronism with the lifting platform 1 which performs its horizontal lower run along side D. In this manner (see FIG. 2) the article P is deposited on the lifting platform 1 which is ready to start its vertical upwardly directed lifting run A (see FIG. 1).

Figure 9:
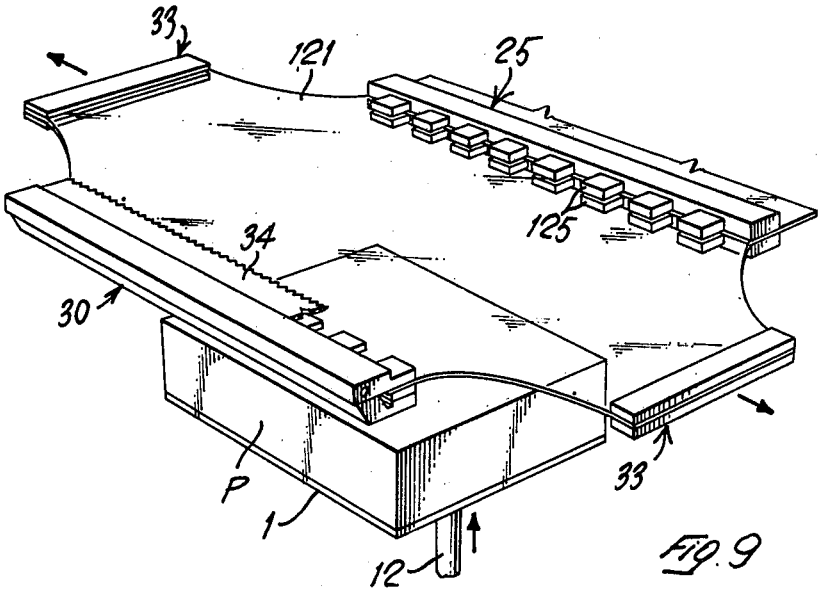
FIGS. 9 and 10 illustrate in perspective view two details of the wrapping of an article.
Figure 10:
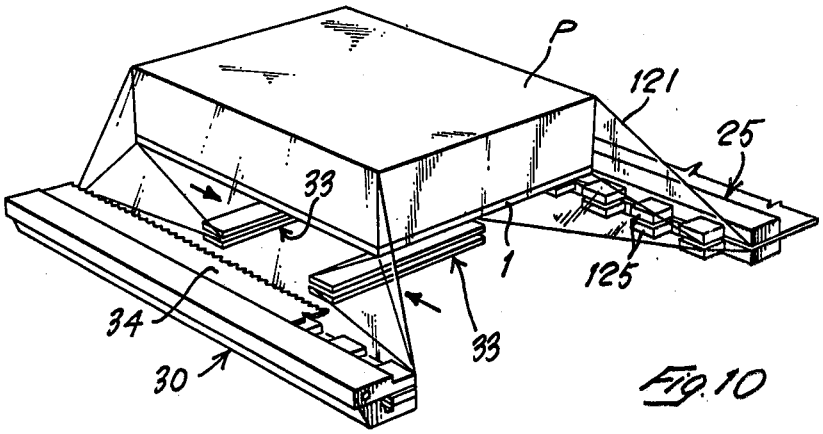

In the meantime, the unreeling clamp 30 has moved towards the distributing clamp 25 and has gripped the leading edge of the film web thanks to its particular construction (see identations 125, FIGS. 9 and 10); then, it has moved horizontally away from the said distributing clamp 25, thus positioning a portion 121 of film above the lifting platform 1, having the article P positioned thereon. At this stage (see FIG. 9) the side clamps 33 grip the transversal edges of the film portion 121 and stretch the said film portion in a direction which is transversal to the unreeling direction, as taught, for example, by U.S. Pat. No. 3,967,433.

In the meantime (see FIGS. 3 and 10) the lifting platform 1 with the article P positioned thereon is lifted against the film portion 121 being held by its leading and trailing edges (referred to the direction of unreeling) respectively by the clamps 30 and 25, and by the side edges by the opposed clamps 33. If desired, the clamp 25 may allow some frictional slippage of the film, in order to avoid an excessive stretching of the film itself. Simultaneously, the structure 26 is lifted so as to constitute a barrier which blocks the article P against any side displacement in the direction of the upper horizontal run B of the lifting platform.

The side clamps 33 are then moved toward each other under the lifting platform 1, so as to fold the transverse side edges of the film portion 121 and effect the lateral wrapping of the article without any further stretching of the film. Thereafter (see FIG. 4) the folding and supporting platform 31 moves in the direction of the lifting platform 1, while this latter moves away along the upper horizontal side B of its quadrangular path. Simultaneously, the unreeling clamp 30 accompanies the movement of the said folding platform 31, while the side clamps 33 are opened so as to progressively release the side edges of the film in accordance with the movement of the said platform 31. In this manner, the platform 31 progressively and smoothly takes the place of the lifting platform 1, while folding the leading edge of the film under the article P which cannot follow the side displacement of the platform since it is blocked by the barrier provided by the platform 27 in its elevated position.

Figures 3, 4, 5:
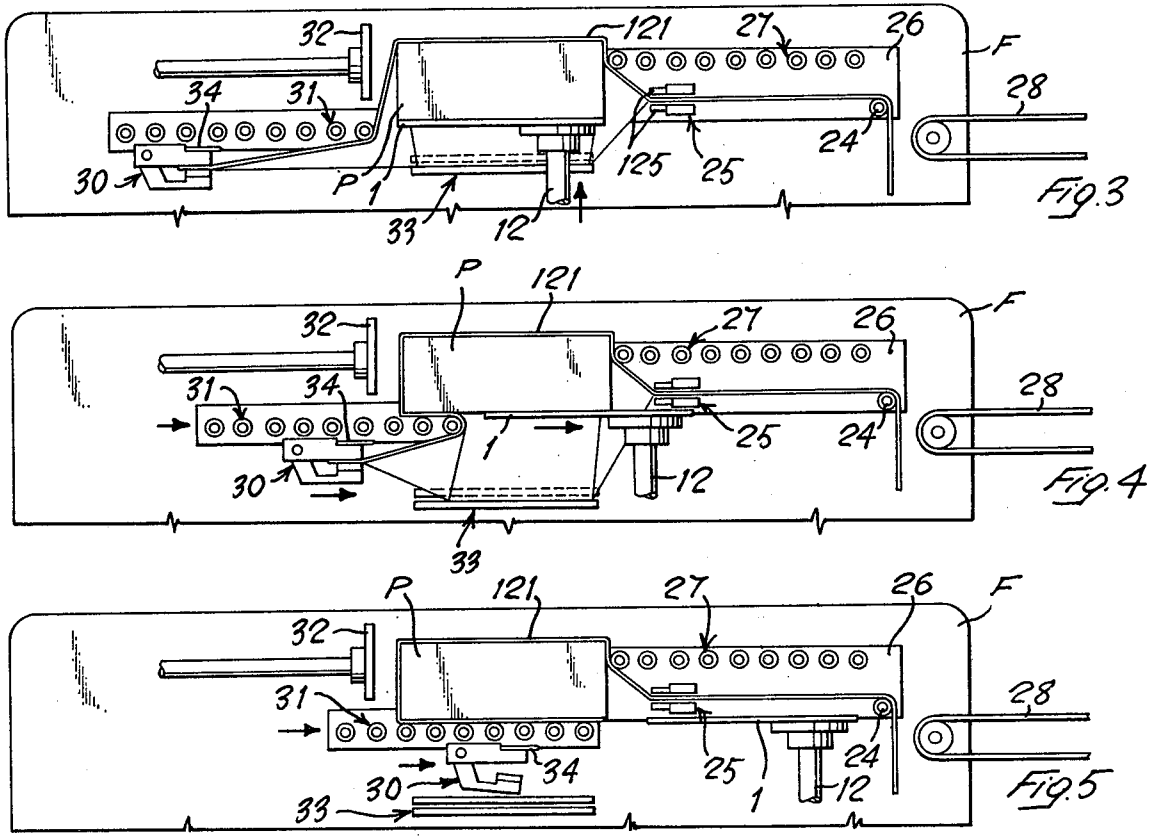

The synchronous and concurrent movement of folding platform 31 and of lifting platform 1 continues until platform 31 has completely substituted the said lifting platform 1 in supporting the article P, and the bottom folding of the leading edge of the film has also been completed since the clamp 30 has released said edge (FIG. 5).

Figure 6:
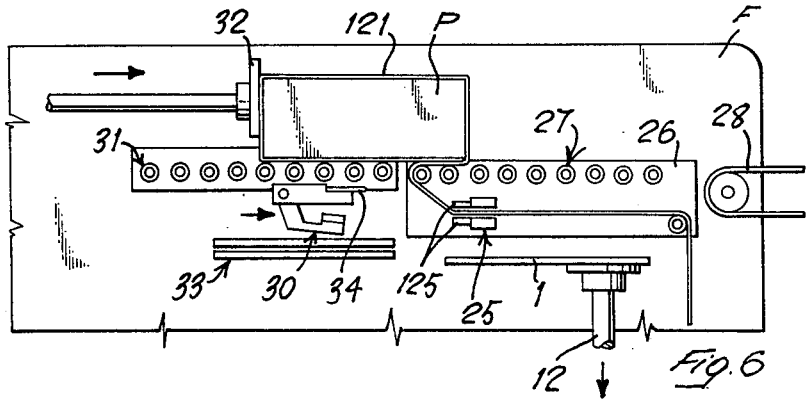
Figure 7:
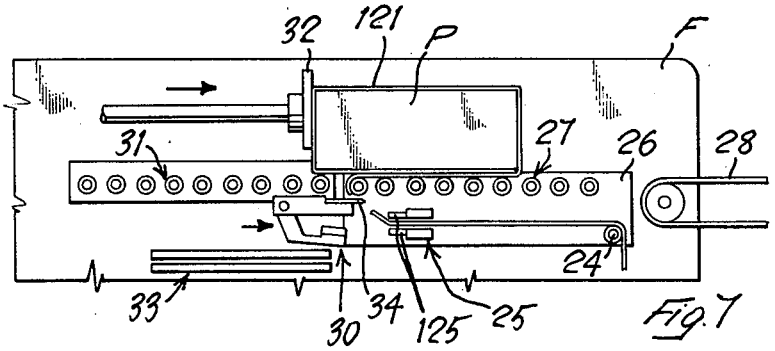
Figure 8:
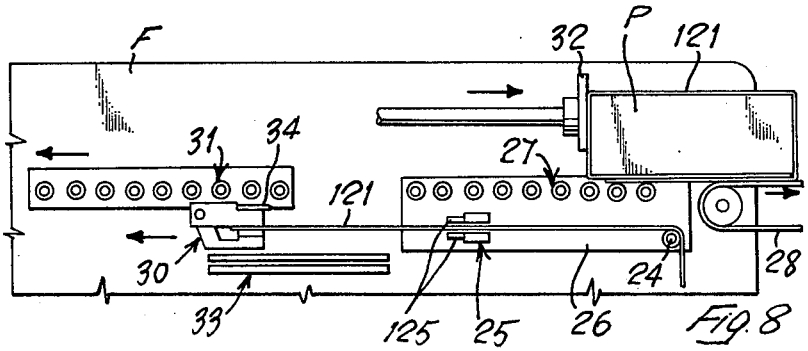

At this moment (FIG. 6) the structure 26 is lowered and the thrusting member 32 pushes the almost completely wrapped article along the platform 27, so that the folding of the trailing edge of the film over the already folded leading edge is effected. In the meantime, the platform 1 has initiated its downwardly directed vertical run C. The clamp 30 (FIG. 7) continues its movement toward the clamp 25, and finally it severs with its cutting blade 34 the film portion from the continuous web. The clamp 30 then reaches the distributing clamp 25 and grips a new leading edge of the continuous web of film, then it returns backwardly, unreeling a new film portion 121, while the completely wrapped articles is pushed onto the discharge conveyor 28 (FIG. 8). The machine is then set for a new wrapping cycle.

I claim:

1. A machine for wrapping articles in stretchable film, comprising:

a. a lifting platform for supporting one or more articles to be wrapped, b. means for moving said lifting platform along a substantially quadrangular closed path so as to sequentially effect a vertical upwardly directed lifting run, a horizontal upper run, a vertical downwardly directed run and a horizontal lower run;

c. means for feeding one or more articles to be wrapped onto the lifting platform in such a manner that the platform is loaded with said one or more articles before starting its upwardly directed lifting run;

d. means for positioning a portion of stretchable film above the lifting table in correspondence of the lifting run;

e. means for blocking the article or articles supported by the lifting platform against side displacement, during the horizontal upper run of the said platform;

f. bottom folding and supporting means for folding an edge section of said portion of stretchable film beneath the bottom of said article or articles and for supporting same, taking the place of the lifting platform while this latter performs its horizontal upper run; and g. discharge means for discharging the article or articles from the said bottom folding and supporting means.

2. A machine according to claim 1, in which the lifting platform moves along the quadrangular path at variable speeds, said moving means providing for increasing the speed of the platform whenever same starts its movement from a vertex of a side of the quadrangular path towards the opposed vertex, bringing the speed to a maximum in correspondence of the middle of the side and decreasing the speed as the platform gets near to the said opposed vertex of the side.

3. A machine according to claim 1, in which the lifting platform has a supporting surface which is constructed as a flat horizontal surface.

4. A machine according to claim 1, in which the said bottom folding and supporting means comprises a horizontal platform located at the level of the lifting platform during the upper horizontal run of this latter, and movable concurrently with said lifting platform during said upper horizontal run.

5. A machine according to claim 1, in which the means for feeding the article or articles to be wrapped onto the lifting platform comprises a horizontal intermediate platform located at the level of the lifting platform during the horizontal lower run, said intermediate platform being movable concurrently with said lifting platform during said horizontal lower run, fixed barrier means being provided so as to promote the discharge of the articles from the intermediate platform, on which said articles have been previously loaded, onto the lifting platform during the concurrent movement of both platforms.

* * * * *